United States Patent [19]

Nemoto et al.

[11] Patent Number: 4,940,960

[45] Date of Patent: Jul. 10, 1990

[54] HIGHLY DENSIFIED VOLTAGE NON-LINEAR RESISTOR AND METHOD OF MANUFACTURING THE SAME

[75] Inventors: Hiroshi Nemoto, Nagoya; Koichi Umemoto, Toyota; Shinji Kawasaki, Nagoya, all of Japan

[73] Assignee: NGK Insulators, Ltd., Japan

[21] Appl. No.: 285,528

[22] Filed: Dec. 16, 1988

[30] Foreign Application Priority Data

Dec. 22, 1987 [JP] Japan ..... 62-322992
Nov. 24, 1988 [JP] Japan ..... 63-294501

[51] Int. Cl.[5] ..... H01C 7/00; H01C 7/10

[52] U.S. Cl. ..... 338/13; 338/20; 338/21; 29/610.1; 29/617

[58] Field of Search ..... 338/13, 20, 21; 361/117, 127; 29/610.1, 617

[56] References Cited

U.S. PATENT DOCUMENTS 3,953,375 4/1976 Nagano et al. ..... 338/21 X
4,046,847 9/1977 Kresge ..... 338/21 X
4,103,274 7/1978 Burgess et al. ..... 338/21
4,142,996 3/1979 Wong et al. ..... 338/21 X
4,420,737 12/1983 Miyoshi et al. ..... 29/610.1 X

*Primary Examiner*—Bruce A. Reynolds
*Assistant Examiner*—Marvin M. Lateef
*Attorney, Agent, or Firm*—Arnold, White & Durkee

[57] ABSTRACT

In case of manufacturing a voltage non-linear resistor, a sintering process is divided into two completely separate steps, i.e. primary and secondary sinterings. The primary sintering is carried out under a reduced pressure and the second sintering is conducted under an atmospheric pressure with a sufficient amount of oxygen. The primary sintering is effects such that the relative density and open porosity of the primarily sintered body are 85% or more and 1% or less, respectively. The secondary sintering removes to a large extent, voids existing in the body and, oxidation of the body is sufficiently effected. Therefore, the finally sintered body has a high density, a large surge withstanding capability, and a high non-linearity index.

11 Claims, No Drawings

HIGHLY DENSIFIED VOLTAGE NON-LINEAR RESISTOR AND METHOD OF MANUFACTURING THE SAME

BACKGROUND OF THE INVENTION

Field of the Invention and Related Art Statement

The present invention relates to a voltage non-linear ceramic resistor composed mainly of zinc oxide. More particularly, the invention relates to a method of manufacturing a voltage non-linear resistor to be used in overvoltage-protecting devices such as lightning arrestors, and also relates to a highly densified voltage non-linear resistor.

Since the voltage non-linear resistors composed mainly of zinc oxide have excellent non-linear voltage-current characteristics, they are widely used in lightning arrestors and surge absorbers to stabilize the voltage and to absorb surges. In case of manufacturing the voltage non-linear resistor, a small amount of an oxide or oxides of bismuth, antimony, cobalt and/or manganese, which serve as a substance for introducing the voltage non-linearity in the sintered body, is mixed with zinc oxide which serves as the main component, and then the mixture is granulated and shaped into a desired configuration. The shaped body is then subjected to a sintering process. In a preferred case, an inorganic material is applied on a side surface of the sintered body and, thereafter the assembly is subjected to a secondary sintering process, to form a high resistance layer. Electrodes made of aluminum, for example, are then applied on opposite surfaces of the finally sintered body. In order to use the thus obtained voltage non-linear resistor in the lightning arrestor in which very large surges have to be absorbed, it is desirable to make the surge withstanding capability of the voltage non-linear resistor as large as possible. The surge withstanding capability of the voltage non-linear resistor may be represented by the maximum electric current value at which the resistor is not broken down or a flashover does not occur under the application of an impulse electric current having a waveshape of 4/10 microseconds two times for each five minutes and stepping up the electric current value.

It is considered that the value of surge withstanding capability of the voltage non-linear resistor depends on the amount and diameter of voids existing in the sintered body. That is to say, it is considered that when applying the 4/10 μs impulse electric current to the voltage non-linear resistor, the destruction of the resistor is caused by thermal stress. Therefore, if the mechanical strength of the sintered body is made high by decreasing the voids in the sintered body, it is expected that the surge withstanding capability thereof would be improved, since the electric current is likely to be concentrated at the tip of the void. If such local concentration of electric current occurs at the tip of the void, the temperature at the tip of the void is locally increased, because the heat conduction of the sintered body surrounding the void is small under applying the electric current for only a short time such as 4/10 μs. If the thermal stress generated by this temperature increase becomes more than the mechanical strength of the sintered body, the resistor would be broken. Therefore, it is necessary to make the mechanical strength of the sintered body high and to remove the voids for the purpose that local concentration of electric current will not likely occur.

Further, in order to effectively prevent an electric discharge caused by the flashover of the voltage non-linear resistor, it is necessary to improve the coherency of the high resistor layer onto the side surface of the sintered body.

Japanese Patent Laid-open Publication, Kokai Sho No. 58-28,802 discloses a method of reducing the voids in voltage non-linear resistors, in which the shaped body is heated up to 1,300° C. and during this heating cycle, the sintering is carried out under a reduced pressure lower than the atomspheric pressure within a temperature range from 800° C. to 1,150° C. In this publication, it is only indicated that the surge withstanding capability under the application of 2 ms rectangular electric current is improved, but there is no indication of the characteristic with respect to the surge withstanding capability under the application a 4/10 μs impulse electric current. In a case where the 2 ms rectangular electric current is applied to the voltage non-linear resistor and the value thereof is stepped up until the resistor is broken, the feedthrough breakdown would occur in the resistor. On the other hand, in case of applying the 4/10 μs impulse electric current, the feedthrough breakdown is not generated, but the parting breakdown would occur. Therefore, it is considered that the voids existing in the sintered body act in different manners on the surge withstanding capability for the 2 ms rectangular electric current and 4/10 μs impulse electric current. The feedthrough breakdown is a breakdown such that a hole having a diameter of about 1 mm is formed through the voltage non-linear resistor and thus the resistance thereof becomes 1 kΩ or less so that the non-linear voltage current characteristic is substantially removed. The parting breakdown is a breakdown by which the voltage non-linear resistor is cracked or crushed and is broken into many pieces. As explained above, it is considered that the parting breakdown is attributable to the thermal stress generated in the sintered body when the impulse electric current is applied thereto.

Also, in the method disclosed in the Japanese Patent Laid-open Publication Kokai Sho No. 58-28,802, the shaped body is sintered under the reduced pressure until the sintering temperature becomes 1,150° C., so that the added component or components as an additive are vaporized and the uniformly sintered body can not be obtained. Additionally the oxidation of the sintered body is started when the sintering temperature becomes over 1,150° C. Therefore, if the shaped body has a large dimension such as 47 mm in diameter, 25 mm thickness, oxidation is not effected sufficiently into the center of the body, so that the non-linear voltage current characteristics which are the same as that of a resistor sintered under normal pressure can not be obtained. If the sintering time is extended in order that sufficient oxidation is effected inside the sintered body, zinc oxide grains are grown excessively in the sintered body, so that the threshold voltage ($V_{lmA/mm}$) at which the resistor begins to show the non-linear voltage-current characteristic becomes unfavorably low. This threshold voltage ($V_{lmA/mm}$) is a voltage at which the non-linear voltage current characteristic appears, and may be defined as a voltage appearing across unit thickness viewed in the direction of the electric current when the electric current of 1 mA is supplied to the resistor under the application.

As a measure for restraining the evaporation of the added component during sintering under reduced pressure, it is suggested that the shaped body is buried in powders including the relevant component and is then sintered. In this case, if the sintering temperature is increased until the sintered body is densified, the powders are adhered or applied to the sintered body so strongly that the side surface of the body is not smooth.

Furthermore, it is necessary to form high resistance layers on the side surfaces of voltage non-linear resistors to be used in the over-voltage protecting devices such as normal lightning arrestors in order to effectively prevent flashover along the side surface. The resistance layer is usually formed by applying an inorganic material layer on the side surface of the body to be sintered, and reacting the inorganic material with the material constituting said surface by sintering the body. Therefore, it is very important that the inorganic material applied on the surface is not separated therefrom during the sintering. In the known method disclosed in Japanese Patent Publication Kokai Sho No. 58-28,802, the coherency between the body to be sintered and the inorganic material is small because the body to which the inorganic material should be applied is a shaped body or a degreased body. Also, since the body to be sintered suddenly shrinks at a sintering temperature of about 850° C., there is a so large difference in the shrinkage between the inorganic material and the shaped body to be sintered, and thus, the inorganic material peels from the body. Thus, there is a drawback in the conventional art that the high resistance layer can not be formed firmly and uniformly on the side surface of the voltage non-linear resistor.

SUMMARY OF THE INVENTION

The object of the present invention is, obviating the above-mentioned inconvenience, to provide a method of manufacturing a voltage non-linear resistor having an excellent voltage non-linear characteristic and a high density.

It is another object of the invention to provide a method of manufacturing a voltage non-linear resistor in which the high resistance layer can be formed easily and positively on the side surfaces of the resistor.

It is still another object of the invention to provide a highly densified voltage non-linear resistor.

According to the invention, a method of manufacturing a voltage non-linear resistor comprises the following steps;

forming a mixture of zinc oxide powders and at least one kind of additive powders which exhibit the voltage non-linearity in a sintered body;

granulating the mixture to form mixture grains; shaping the mixture grains into a shaped body having a desired shape and size;

effecting a primary sintering for heating the shaped body under a reduced pressure lower than atmospheric pressure; and effecting a secondary sintering for heating the primarily sintered body under an oxidizing atmosphere having a partial pressure of oxygen higher than that of the primary sintering.

According to a further aspect of the invention, a voltage non-linear resistor comprises: a sintered body comprising zinc oxide as a main composition and at least one kind of additives which exhibit voltage non-linearity in the sintered body, and the sintered body has a relative density of at least 97%, preferably at least 98%.

In the above-described method according to the invention, the sintering is carried out in two completely separate steps. That is to say, the primary sintering (provisional sintering) is carried out under reduced pressure, and thereafter the secondary sintering (regular sintering) is performed under a partial pressure of oxygen which is higher than that of the primary sintering. Voids are removed to a large extent during the primary sintering under reduced pressure and additionally a small amount of remaining voids are almost all removed from the body during the secondary sintering. Further, oxidation is sufficiently carried out during the secondary sintering. Thus, the sintered body having high density and excellent non-linear voltage-current characteristics can be obtained and the surge withstanding capability of the thus obtained body will be improved.

In a preferred embodiment of the method according to the present invention, the primary sintering is carried out under reduced pressure such that the relative density and the open porosity of the sintered body obtained after the primary sintering become 85% or more and 1% or less, respectively. The voltage non-linear resistor having a relative density equal to or higher than 98% can then be, obtained by sintering the body under the normal pressure without using a complicated and expensive densification technique such as HIP (Hot Isostatic Press), etc.

That is to say, in order to remove the voids sufficiently from the finally sintered body during the secondary sintering process under normal pressure, the sintered body after the primary sintering should satisfy the condition that the density and open porosity thereof are 85% or more and 1% or less, respectively. It has been experimentally confirmed that the above mentioned condition could be satisfied when the primary sintering under the reduced pressure is carried out for 1~10 hours at a temperature of 900°~1,000° C. The density of the shaped body and the dispersion of additives ($Bi_2O_3$, etc.) also effect the quality of the preliminarily sintered body. That is to say, when the density of the shaped body is high, or when the dispersion of additives is high, the shaped body is densified at a lower temperature. Therefore, it is possible to make the primary sintering temperature low, so that the evaporation of additives is restricted to a large extent, and thus, a uniformly sintered body can be obtained.

It is possible to obtain the primarily sintered body having the density of 85% or more and the open porosity of 1% or less by sintering the shaped body under the atmospheric pressure. However, in this case, the pressure in the voids exiting in the sintered body becomes high, and a viscosity of liquid phase formed by the additives becomes high so that the distribution of the liquid phase becomes non-uniform. Therefore, if the thus sintered body is subjected to the secondary sintering under the same condition as that according to the present invention, the relative density of 98% or more could not be achieved. Namely, the very high relative density of 98% or more can never be achieved unless the primary sintering is carried out under reduced pressure as defined in the present invention.

In the present invention, since the primary sintering is carried out under reduced pressure, in case that an additive having a high vapor pressure such as $Bi_2O_3$ is used, $Bi_2O_3$ is likely to be evaporated. In order to prevent the evaporation of $Bi_2O_3$, it is desirable to effect the primary sintering while the shaped body is buried in powders which consist of zinc oxide as the main component and at least $Bi_2O_3$. Further, it is more desirable that the powders have the same chemical composition as that of the body to be sintered. The effect of such buried sintering under the reduced pressure will be explained below. That is to say, in the vicinity of the boundary between the powders and the sintering atmosphere, the high vapor pressure component in the powders, such as $Bi_2O_3$, is activety evaporated, but in the vicinity of the surface of the body to be sintered, the evaporation of $Bi_2O_3$ from the body is restrained because the $Bi_2O_3$ vapor pressure is almost saturated therein. On the other hand, since the partial pressures of oxygen and nitrogen are reduced in a furnace, the air which goes out of the body is exhausted into the atmosphere in the furnace. Even if the buried sintering is carried out under atmospheric pressure, the air would also be restrained to go out into the atmosphere, so that the voids are not removed sufficiently.

In case the shaped body is not buried in the powders during preliminary sintering, the powders should not cohere with the body so strong otherwise they would not be separated from each other thereafter, and there should not be any non-uniformity of the chemical composition in the sintered body.

Such effects of the buried sintering is achieved only when the primary and secondary sinterings are independently conducted. If the secondary sintering is conducted also in the buried manner, the powders for burying the body would be adhered strongly onto the surface of the body, so that the sintered body having a smooth outer surface can not be obtained.

It has been found experimentally that the desired secondary sintering temperature is 1,050°~1,300° C., otherwise the body would not be densified, oxidation would not be carried out sufficiently up to the inside of the body and therefore an excellent non-linear voltage current characteristic would not be obtained. It is necessary to increase the partial pressure of oxygen during the secondary sintering such that the main component of the sintered body and additives are sufficiently oxidized. According to the invention, it is necessary to effect the secondary sintering in the oxidizing atmosphere having the partial pressure of oxygen higher than that of the primary sintering condition. The normal atmospheric pressure is more desirable because the atmosphere in the furnace can more easily be controlled. In this case, it is possible to pressurize the air or oxygen in the furnace during the secondary sintering in order to promote the oxidation of the sintered body.

As explained above, the primary sintering density guarantees high densification, and the secondary sintering promotes oxidation and densification as well as the grain growth of zinc oxide in the sintered body. Thus, the diameter zinc oxide grains in the sintered body can be easily controlled, and thus the voltage non-linear resistor having the desired threshold voltage ($V_{lmA}$) can be manufactured.

In a preferred embodiment of the method according to the invention, after the primary sintering, an inorganic material layer is applied on the side surface of the body and thereafter the assembly is subjected to the secondary sintering. In this case, since the adhesive force between the first sintered body and the inorganic material layer is strong and the primarily sintered body is not substantially shrunk during the secondary sintering, and thus the difference in shrinkage between the body and the inorganic material layer applied thereon is small. Therefore, the high resistance layer is firmly adhered onto the side wall of the sintered body, so that flashover can be effectively prevented.

Description of the Preferred Embodiments

EXAMPLE 1

To ZnO powders were mixed with additive powders ratios $Bi_2O_3$, $Sb_2O_3$, $Cr_2O_3$, $Co_2O_3$, $MnO_2$, NiO, $SiO_2$ and $Al_2O_3$ the ratios listed in a Table 1, column 1. After the mixture was mixed with a binding agent to form a slurry, the slurry was granulated to obtain grains. The paste was then shaped into a cylindrical body. In this manner, forty cylindrical bodies were made. The thus formed cylindrical bodies were embedded in powders consisting of the same chemical composition as that of the mixture and were then placed in a furnace. The shaped bodies were embedded to the powders in a depth of 10 mm from the surface thereof. The furnace was then heated from room temperature to 900° C. at a heating rate of about 50° C./hr. It should be noted that this heating step is continued for about eighteen hours. Before initiating the heating, the pressure inside the furnace was reduced to 1 Torr or when the temperature of the furnace was increased near 900° C., the pressure inside the furnace was reduced to 1 Torr. The shaped body was then heated at 900° C. for two hours under the reduced pressure of 1 Torr. The furnace was then cooled at the usual cooling rate of about 60° C./hr to room temperature. In this manner, the primary sintering process was carried out for about thirty six hours. The relative density and open porosity of primarily sintered bodies were then measured by means of the usual methods. The results of these measurements are also listed in Table 1.

An inorganic material paste consisting of $Bi_2O_3$, $Sb_2O_3$ and $SiO_2$ was then applied on the side wall of the body. After the inorganic material layer was dried to evaporate a binder solvent, the bodies were placed in a furnace and the furnace was heated from room temperature to 1,300° C. at a rate of 50° C./hr. Then, the furnace was maintained at 1,300° C. for five hours under atmospheric pressure of 760 Torr. The furnace was then cooled at a rate of about 60° C./hr to the room temperature. In this manner, the secondary sintering was carried out under atmospheric pressure for more than fifty hours. The relative density of ten sintered bodies was then measured. At the same time, the mechanical strength of ten sintered bodies measured. This measurement was effected under the testing method defined by JIS (Japanese Industrial Standards) R1601, i.e. the flexural strength was measured by applying a load at four points. An average value and its standard deviation were derived in a unit of mega Pascal (MPa). The measured values are also listed in Table 1.

Opposite surfaces of the remaining twenty cylindrical sintered bodies were polished and aluminum electrodes were applied on the polished surfaces by aluminum flange spraying. In this manner, twenty voltage non-linear resistors having a diameter of 47 mm and a thickness of 22.5 mm with the electrodes having a diameter of 46 mm were obtained. Then the threshold voltage $V_{lmA/mm}$ under the application of the electric current of 1 mA, the non-linear index $\alpha$, and the surge withstanding capability were measured. It should be noted that the non-linear index $\alpha$ is represented by an equation, $I=(V/C)^{\alpha}$, wherein I represents the current, V the voltage and C denotes a constant. Further, the surge withstanding capability was measured by supplying 4/10 μs impulse current to the resistors twice with interposing a pause of five minutes and by increasing the amplitude of the current from 60 KA in a stepwise manner at a step of 10 KA until the resistor was broken. An average current at which the twenty resistors were broken and its standard deviation are indicated in Table 1 together with $V_{1mA/mm}$ and $\alpha$.

Similar experiments were conducted by varying various factors such as the composition of the mixture, and the maximum temperature and time period of the primary and secondary sintering processes. The similar data as that explained above with reference to the Example 1 are also shown in Table 1.

TABLE 1

| | | Example | | | | | | | | | |
|---|---|---|---|---|---|---|---|---|---|---|---|
| | No. | 1 | 2 | 3 | 4 | 5 | 6 | 7 | 8 | 9 | 10 |
| Mixture ratio mol % | $Bi_2O_3$ | 1.0 | 1.0 | 1.0 | 1.0 | 1.0 | 1.0 | 1.0 | 1.0 | 1.0 | 1.0 |
| | $Sb_2O_3$ | 1.0 | 1.0 | 1.0 | 1.0 | 1.0 | 1.0 | 1.0 | 1.0 | 1.0 | 1.0 |
| | $Cr_2O_3$ | 0.5 | 0.5 | 0.5 | 0.5 | 0.5 | 0.5 | 0.5 | 0.5 | 0.5 | 0.5 |
| | $Co_2O_3$ | 1.0 | 1.0 | 1.0 | 1.0 | 1.0 | 1.0 | 0.5 | 0.5 | 0.5 | 0.5 |
| | $MnO_2$ | 0.5 | 0.5 | 0.5 | 0.5 | 0.5 | 0.5 | 0.5 | 0.5 | 0.5 | 0.5 |
| | $SiO_2$ | 1.5 | 1.5 | 1.5 | 1.5 | 1.5 | 1.5 | 0.5 | 0.5 | 8.0 | 8.0 |
| | NiO | 1.0 | 1.0 | 1.0 | 1.0 | 1.0 | 1.0 | — | — | 1.0 | 1.0 |
| | $Al_2O_3$ | 0.0025 | 0.0025 | 0.0025 | 0.0025 | 0.0025 | 0.0025 | — | — | 0.0025 | 0.0025 |
| | ZnO | remainder | remainder | remainder | remainder | remainder | remainder | remainder | remainder | remainder | remainder |
| Primary sintering | Atmospheric pressure (Torr) | 1 | 1 | 1 | 1 | 1 | 1 | 1 | 1 | 1 | 1 |
| | Temperature (°C.) | 900 | 900 | 900 | 1,000 | 1,000 | 1,000 | 900 | 1,000 | 900 | 1,000 |
| | Time (hr) | 2 | 2 | 2 | 2 | 2 | 2 | 2 | 2 | 2 | 2 |
| | Heating rate (°C./hr) | 50 | 50 | 50 | 50 | 50 | 50 | 50 | 50 | 50 | 50 |
| Relative density of primarily sintered body (%) | | 88.4 | 88.4 | 88.4 | 94.2 | 94.2 | 94.2 | 86.4 | 92.1 | 88.7 | 95.1 |
| Open porosity (%) | | 0.5 | 0.5 | 0.5 | 0.2 | 0.2 | 0.2 | 0.6 | 0.4 | 0.3 | 0.3 |

| | | Comparative Example | | | | | | | | | | |
|---|---|---|---|---|---|---|---|---|---|---|---|---|
| | No. | 1 | 2 | 3 | 4 | 5 | 6 | 7 | 8 | 9 | 10 | 11 |
| Mixture ratio mol % | $Bi_2O_3$ | 1.0 | 1.0 | 1.0 | 1.0 | 1.0 | 1.0 | 1.0 | 1.0 | 1.0 | 1.0 | 1.0 |
| | $Sb_2O_3$ | 1.0 | 1.0 | 1.0 | 1.0 | 1.0 | 1.0 | 1.0 | 1.0 | 1.0 | 1.0 | 1.0 |
| | $Cr_2O_3$ | 0.5 | 0.5 | 0.5 | 0.5 | 0.5 | 0.5 | 0.5 | 0.5 | 0.5 | 0.5 | 0.5 |
| | $Co_2O_3$ | 1.0 | 1.0 | 1.0 | 1.0 | 1.0 | 1.0 | 1.0 | 1.0 | 1.0 | 1.0 | 1.0 |
| | $MnO_2$ | 0.5 | 0.5 | 0.5 | 0.5 | 0.5 | 0.5 | 0.5 | 0.5 | 0.5 | 0.5 | 0.5 |
| | $SiO_2$ | 1.5 | 1.5 | 1.5 | 1.5 | 1.5 | 1.5 | 1.5 | 1.5 | 1.5 | 1.5 | 1.5 |
| | NiO | 1.0 | 1.0 | 1.0 | 1.0 | 1.0 | 1.0 | 1.0 | 1.0 | 1.0 | 1.0 | 1.0 |
| | $Al_2O_3$ | 0.0025 | 0.0025 | 0.0025 | 0.0025 | 0.0025 | 0.0025 | 0.0025 | 0.0025 | 0.0025 | 0.0025 | 0.0025 |
| | ZnO | remainder | remainder | remainder | remainder | remainder | remainder | remainder | remainder | remainder | remainder | remainder |
| Primary sintering | Atmospheric pressure (Torr) | 1 | 1 | 1 | 1 | 1 | | | | 760 | 760 | 1 |
| | Temperature (°C.) | 850 | 850 | 850 | 850 | 1,000 | | | | 900 | 1,000 | 900 |
| | Time (hr) | 2 | 2 | 2 | 10 | 2 | | | | 2 | 2 | 2 |
| | Heating rate (°C./hr) | 50 | 50 | 50 | 50 | 200 | | | | 50 | 50 | 50 |
| Relative density of primarily sintered body (%) | | 83.7 | 83.7 | 83.7 | 88.5 | 84.2 | | | | 84.3 | 89.3 | 88.4 |
| Open porosity (%) | | 16.2 | 16.2 | 16.2 | 9.8 | 0.4 | | | | 0.6 | 0.3 | 0.5 |

| | | Example | | | | | | | | | |
|---|---|---|---|---|---|---|---|---|---|---|---|
| | No. | 1 | 2 | 3 | 4 | 5 | 6 | 7 | 8 | 9 | 10 |
| Secondary sintering | Atmospheric pressure (Torr) | 760 | 760 | 760 | 760 | 760 | 760 | 760 | 760 | 760 | 760 |
| | Temperature (°C.) | 1,300 | 1,100 | 1,050 | 1,300 | 1,100 | 1,050 | 1,100 | 1,050 | 1,100 | 1,050 |
| | Time (hr) | 5 | 5 | 5 | 5 | 5 | 5 | 5 | 5 | 5 | 5 |
| | Heating rate (°C./hr) | 50 | 50 | 50 | 50 | 50 | 50 | 50 | 50 | 50 | 50 |
| Relative density of secondarily sintered body (%) | | 98.7 | 99.4 | 99.6 | 98.5 | 99.5 | 99.3 | 99.4 | 98.9 | 99.6 | 99.1 |
| Strength (MPa)n = 10 | Mean value | 118 | 129 | 137 | 121 | 127 | 134 | 127 | 132 | 158 | 162 |
| | Standard deviation | 5 | 4 | 10 | 7 | 5 | 6 | 5 | 3 | 6 | 6 |
| $V_{1mA}$/mm (V) | | 172 | 330 | 405 | 167 | 328 | 404 | 322 | 403 | 465 | 481 |
| α | | 52 | 47 | 49 | 47 | 58 | 46 | 68 | 65 | 35 | 37 |
| Withstanding | Mean value | 222 | 101 | 82 | 225 | 104 | 83 | 90 | 77 | 62 | 55 |
| | Standard deviation | 9 | 4 | 5 | 7 | 5 | 6 | 4 | 5 | 4 | 3 |

TABLE 1-continued

| | | Comparative Example | | | | | | | | | | |
|---|---|---|---|---|---|---|---|---|---|---|---|---|
| | No. | 1 | 2 | 3 | 4 | 5 | 6 | 7 | 8 | 9 | 10 | 11 |
| Secondary sintering | Atmospheric pressure (Torr) | 760 | 760 | 760 | 760 | 760 | 1 → 760 | 1 → 760 | 1 → 760 | 760 | 760 | 1 |
| | Temperature (°C.) | 1,300 | 1,100 | 1,050 | 1,300 | 1,300 | 1,100 | 1,100 | 1,100 | 1,100 | 1,100 | 1,100 |
| | Time (hr) | 5 | 5 | 5 | 5 | 5 | 5 | 10 | 10 | 5 | 5 | 5 |
| | Heating rate (°C./hr) | 50 | 50 | 50 | 50 | 50 | 50 | 50 | 200 | 50 | 50 | 50 |
| Relative density of secondarily sintered body (%) | | 96.2 | 95.8 | 95.7 | 96.3 | 97.1 | 96.4 | 96.7 | 95.1 | 95.2 | 95.7 | 99.5 |
| Strength (MPa)n = 10 | Mean value | 98 | 109 | 112 | 101 | 104 | 108 | 111 | 95 | 105 | 104 | 130 |
| | Standard deviation | 3 | 5 | 7 | 7 | 6 | 8 | 9 | 3 | 5 | 5 | 11 |
| $V_{1mA}$/mm (V) | | 175 | 336 | 407 | 173 | 170 | 250 | 270 | 339 | 335 | 333 | ≦10 |
| $\alpha$ | | 49 | 42 | 46 | 51 | 47 | 8 | 42 | 49 | 55 | 47 | 1 |
| Withstanding capability (KA)n = 30 | Mean value | 188 | 82 | 64 | 191 | 194 | flashover | flashover | flashover | 80 | 84 | not measured |
| | Standard deviation | 6 | 8 | 5 | 8 | 9 | | | | 6 | 7 | |

As is seen in Table 1, in Examples 1~6 according to the present invention the relative density and open porosity of the primarily sintered bodies are larger than 88% and smaller than 0.5%, respectively, and the relative density of the secondarily sintered body is larger than 98%. It has been experimentally confirmed that the threshold voltage at which the non-linearity begins to appear can be adjusted by controlling the secondary sintering temperature. In this manner, according to the invention, it is possible to manufacture the voltage non-linear resistor having the high density and high surge withstanding capability. It was also proven from the Examples 7~10 that even if the composition constituting the body to be sintered are different, the same results described above can be obtained.

In Table 1, there are also shown eleven Comparative Examples. In the Comparative Examples 1~3, the primary sintering temperature was 850° C., so that the relative density and open porosity of the primarily sintered bodies are less than 84% and more than 16%, respectively. In the Comparative Example 4, during the primary sintering process the bodies were heated at 850° C. for ten hours, so that the relative density is higher than 88%, but the open porosity is larger than 9%. In the Comparative Example 5, the bodies were heated up to 1,000° C. at the rate of 200° C./hr. In this case, although the open porosity is smaller than 0.5%, the relative density is smaller than 85%. The Comparative Examples 6~8 are similar to the known method disclosed in the above mentioned Japanese Laid-open Publication, Kokai Sho 58-28,802. In these examples, the relative density of the sintered bodies is smaller than 97%. It was further found that the inorganic material layer was not firmly adhered to the side wall of the cylindrical body, so that the flashover could not be prevented efficiently. From the Comparative Example 6, it was proven that the oxidation was not carried out sufficiently, so that the non-linearity index $\alpha$ is very small. From the Comparative Example 8, it was also confirmed that when the heating rate is made higher, the densitification of the sintered body could not be achieved even if the sintering is partially effected under the reduced pressure. In the Comparative Examples 9 and 10, the primary sintering was carried out under atmospheric pressure instead of reduced pressure. In this case, although the primarily sintered bodies had a relative density higher than 84% and an open porosity smaller than 0.6%, the finally sintered bodies did not have a relative density higher than 96%. In the Comparative Example 11, an second sintering was conducted under reduced pressure. In this case, a relative density of the finally sintered bodies was higher than 99%, but the non-linear index $\alpha$ was too small to carry out the withstanding capability test.

From the above experiments, it has been found that the primary sintering preferably has to be conducted such that the primarily sintered body has a relative density equal to or higher than 85% and an open porosity equal to or lower than 1%. In order to satisfy the above mentioned preferable property, it has been confirmed that the primary sintering temperature should be set to a value within a range of 900°~1,000° C. It is possible to then obtain the finally sintered body having the relative density equal to or higher than 98%.

The inventors of the instant application further conducted experiments, and the experimental data is shown in Table 2. In these experiments the finally sintered cylindrical body had a diameter of 28 mm and a thickness of 18 mm, and the aluminum electrode had a diameter of 25 mm. In Table 2, the void evaluation O represents the condition that there is no void having a diameter of 10 μm or more, and the mark x expresses the condition that voids having a diameter of larger than 10 μm are produced in the sintered body.

It should be noted that the composition of the starting material and the sintering conditions of Example 2 in Table 2 are identical with those of Comparative Example 1 in Table 1, but finally sintered body of Example 2 in Table 2 has the desired property. This is due to the fact that the size of the sintered body of Example 1 in Table 2 is smaller than that of Comparative Example 1 in Table 1.

TABLE 2

| | Example | | | | | | | | | Comparative Example | | |
|---|---|---|---|---|---|---|---|---|---|---|---|---|
| No. | 1 | 2 | 3 | 4 | 5 | 6 | 7 | 8 | 9 | 1 | 2 | 3 |
| Mixture ratio mol % | | | | | | | | | | | | |
| $Bi_2O_3$ | 1.0 | 1.0 | 1.0 | 1.0 | 1.0 | 1.0 | 1.0 | 1.0 | 1.0 | 1.0 | 1.0 | 1.0 |
| $Sb_2O_3$ | 1.0 | 1.0 | 1.0 | 1.0 | 1.0 | 1.0 | 1.0 | 1.0 | 1.0 | 1.0 | 1.0 | 1.0 |
| $Cr_2O_3$ | 0.5 | 0.5 | 0.5 | 0.5 | 0.5 | 0.5 | 0.5 | 0.5 | 0.5 | 0.5 | 0.5 | 0.5 |
| $Co_2O_3$ | 1.0 | 1.0 | 1.0 | 0.5 | 0.5 | 0.5 | 0.5 | 0.5 | 0.5 | 1.0 | 1.0 | 1.0 |
| $MnO_2$ | 0.5 | 0.5 | 0.5 | 0.5 | 0.5 | 0.5 | 0.5 | 0.5 | 0.5 | 0.5 | 0.5 | 0.5 |
| $SiO_2$ | 1.5 | 1.5 | 1.5 | 0.5 | 0.5 | 0.5 | 8.0 | 8.0 | 8.0 | 1.5 | 1.5 | 1.5 |
| NiO | 1.0 | 1.0 | 1.0 | — | — | — | 1.0 | 1.0 | 1.0 | 1.0 | 1.0 | 1.0 |
| $Al_2O_3$ | 0.0025 | 0.0025 | 0.0025 | — | — | — | 0.0025 | 0.0025 | 0.0025 | 0.0025 | 0.0025 | 0.0025 |
| ZnO | remainder | remainder | remainder | remainder | remainder | remainder | remainder | remainder | remainder | remainder | remainder | remainder |
| Primary sintering | | | | | | | | | | | | |
| Atmospheric pressure (Torr) | 1 | 1 | 1 | 1 | 1 | 1 | 1 | 1 | 1 | 760 | 1 | 1 |
| Temperature (°C.) | 900 | 850 | 1,000 | 900 | 850 | 1,000 | 900 | 850 | 1,000 | 900 | 900 | 900 |
| Time (hr) | 2 | 2 | 2 | 2 | 2 | 2 | 2 | 2 | 2 | 2 | 2 | 2 |
| Secondary sintering | | | | | | | | | | | | |
| Atmospheric pressure (Torr) | 760 | 760 | 760 | 760 | 760 | 760 | 760 | 760 | 760 | 760 | 1 | 760 |
| Temperature (°C.) | 1,100 | 1,300 | 1,050 | 1,100 | 1,300 | 1,050 | 1,100 | 1,300 | 1,050 | 1,100 | 1,100 | 1,100 |
| Time (hr) | 5 | 5 | 5 | 5 | 5 | 5 | 5 | 5 | 5 | 5 | 5 | 5 |
| Void evaluation | O | O | O | O | O | O | O | O | O | X | O | O |
| Bulk density ($g/cm^3$) | 5.80 | 5.65 | 5.80 | 5.78 | 5.64 | 5.77 | 5.46 | 5.32 | 5.47 | 5.41 | 5.79 | 5.79 |
| Stength (MPa)n = 10 | | | | | | | | | | | | |
| Mean value | 137 | 105 | 130 | 129 | 91 | 119 | 160 | 137 | 158 | 105 | 140 | 139 |
| Standard deviation | 7 | 10 | 6 | 4 | 10 | 4 | 5 | 6 | 6 | 5 | 5 | 4 |
| $V_{1mA}$/mm (V) | 329 | 170 | 405 | 324 | 161 | 400 | 461 | 253 | 484 | 330 | ≦10 | 327 |
| $\alpha$ | 58 | 31 | 43 | 70 | 43 | 60 | 35 | 25 | 32 | 60 | 1 | 57 |
| Withstanding capability (KA)n = 30 | | | | | | | | | | | | |
| Mean value | 50.7 | 99.5 | 41.6 | 45.0 | 87.7 | 37.0 | 30.3 | 58.1 | 28.3 | 42.0 | not | flashover |
| Standard deviation | 3.7 | 6.0 | 4.9 | 5.1 | 5.8 | 3.6 | 2.5 | 4.7 | 3.3 | 4.1 | measured | |

In Comparative Example 1 in Table 2, the primary sintering was carried out under an atomospheric pressure of 760 Torr, in Comparative Example 2, the secondary sintering was conducted under a reduced pressure of 1 Torr, and in Comparative Example 3, the inorganic material layer was applied on the side surface of the shaped body before the primary sintering was effected.

As is seen in Table 2, in the voltage non-linear resistor manufactured by the method according to the invention any void having a diameter larger than 10 μm could not be found, and the bulk density and four point flexure strength are sufficiently high. It is also seen from Table 2 that in the voltage non-linear resistor according to the invention, the voltage non-linearity index $\alpha$ is very large and the surge withstanding capability is also high. The reason why the bulk density and surge withstanding capability are improved in the present invention, compared with Comparative Example 1 in which the primary sintering is effected under atmospheric pressure, is as follows. $Bi_2O_3$, one of the compositions of the shaped body, is molten at a temperature about 850° C. and forms a liquid phase, so the body shrinks suddenly at about 850° C. The sudden shrinkage of the body is due to the capillary pressure of the liquid phase, however, under the reduced pressure, the liquid phase is likely to be immersed into the spaces between the particles, and bubbles in the liquid phase are liable to escape from the liquid phase, and thus the body is shrink largely. In other words, the voids are decreased and the bulk density becomes high. As a result, the local electric current concentration at the tip of the void hardly occurs. Further as the voids are decreased, the mechanical strength of the sintered body becomes high. Thus, the breakdown of the resistor due to the thermal stress is so prevented that the surge withstanding capability of the resistor is increased.

In Comparative Example 2, the bulk density is much better than that of Comparative Example 1, but the threshold voltage $V_{lmA/mm}$ and the voltage non-linearity index $\alpha$ are smaller than those of examples according to the present invention because the oxidation during the secondary sintering could not be carried out sufficiently.

In Comparative Example 3, an improvement in the bulk density is recognized, but the inorganic material layer applied on the side surface of body was peeled off due to the sudden shrinkage of the body during the primary sintering. Thus, when 4/10 μs impulse electric current was supplied to the resistor, the flashover occurred and the surge withstanding capability was low.

It is considered that the non-linear voltage current characteristic is caused by the intergranular layers of the additives existing among zinc oxide grains. The non-linear voltage current characteristic of the sintered body is removed by the reduction heat treatment, and is provided again by the oxidation heat treatment (see Journal of Applied Physics, 1983 vol 54, No. 6, pp. 3467~3472). Therefore, it is considered that the supply of oxygen to the intergranular layer is necessary to obtain the non-linear voltage current characteristic in the sintered body. The reason why the threshold voltage $V_{lmA/mm}$ and the non-linearity index $\alpha$ are small in the Comparative Example 2 is that oxygen was not supplied to the intergranular layer sufficiently.

As can be seen from the examples according to the present invention in Tables 1 and 2, the sintered bodies were densified regardless of the composition of the additives, and therefore the present invention should not be limited to the compositions of additives listed in the Tables 1 and 2.

As is evident from the foregoing explanation, in the method according to the present invention, sintering is carried out in two completely separate steps. Namely, the primary sintering is carried out under a reduced pressure at a relatively low temperature and the secondary sintering is conducted under a partial pressure of oxygen higher than that of the primary sintering at a higher temperature. It is preferred that the relative density and open porosity of the primarily sintered body be 85% or more and 1% or less, respectively. Sufficient oxidation is then effected in the sintered body during the secondary sintering. As a result, the finally sintered body having a relative density of 98% or more and an excellent non-linear voltage current characteristic can be obtained, and further the surge withstanding capability can also be improved.

What is claimed is:

1. A voltage non-linear resistor comprising:

a sintered body comprising zinc oxide as a primary constituent; and at least one additive which exhibits voltage non-linearity in the sintered body;

wherein said sintered body has a relative density of at least 97%.

2. A voltage non-linear resistor according to claim 1, wherein said sintered body has a relative density of at least 98%.

3. A voltage non-linear resistor according to claim 1, wherein said at least one kind of additive is selected from the group consisting of oxides of bismuth, antimony, chromium, cobalt, and manganese.

4. A voltage non-linear resistor according to claim 1, wherein said sintered body further comprises $SiO_2$.

5. A method of manufacturing a voltage non-linear resistor comprising the following steps:

forming a mixture of zinc oxide powder and at least one kind of additive powder which exhibits voltage non-linearity in a sintered body;

granulating the mixture to form a batch mixture of grains;

shaping the batch mixture of grains into a shaped body;

effecting a primary sintering for heating the shaped body under a reduced pressure lower than atmospheric pressure to form a primarily sintered body; and effecting a secondary sintering for heating the primarily sintered body under an oxidizing atmosphere having a partial pressure of oxygen higher than that of the primary sintering.

6. A method according to claim 5, further comprising the step of:

applying an inorganic material layer at least on a side surface of the primarily sintered body after the primary sintering.

7. A method according to claim 5, wherein the primary sintering step provides the primarily sintered body with a relative density of 85% or more and an open porosity of 1% or less.

8. A method according to claim 5, wherein the primary sintering is performed at a temperature within a range of 850°~1,000° C.

9. A method according to claim 8, wherein the secondary sintering is carried out at a temperature within a range of 1,000°~1,300° C.

10. A method according to claim 5, wherein the primary sintering is performed at a temperature within a range of 900°~1,000° C.

11. A method according to claim 5, wherein said secondary sintering is carried out at a temperature within a range of 1,050°~1,300° C.

* * * * *